United States Patent [19]

Amador et al.

[11] Patent Number: 4,968,385

[45] Date of Patent: Nov. 6, 1990

[54] METHOD OF PREPARING A PULP USING A FLUIDIZING CENTRIFUGAL PUMP DURING IMPRENATION

[75] Inventors: Julio Amador, Coyoacan, Mexico; Eurico de Faria Amaro, Smiths, Bermuda; Hans T. Haukerud, Drammen, Norway; Ake Backlund, Karlstad, Sweden

[73] Assignee: Kamyr AB, Karlstad, Sweden

[21] Appl. No.: 356,352

[22] Filed: May 25, 1989

[30] Foreign Application Priority Data

Jun. 6, 1988 [SE] Sweden ..... 8802089

[51] Int. Cl.[5] ..... D21B 1/16; D21C 1/00; D21C 1/10; D21C 7/06

[52] U.S. Cl. ..... 162/18; 162/24; 162/25; 162/26; 162/52; 162/96; 162/56

[58] Field of Search ..... 162/18, 56, 57, 52, 162/96, 19, 26, 24, 25

[56] References Cited

U.S. PATENT DOCUMENTS

| | | | |
|---|---|---|---|
| 2,913,362 | 11/1960 | Cusi | 162/96 |
| 2,975,096 | 3/1961 | Ginaven et al. | 162/18 |
| 3,081,218 | 3/1963 | Ambuel et al. | 162/96 |
| 3,620,911 | 7/1969 | Eklund | 162/96 |
| 4,259,150 | 3/1981 | Prough | 162/56 |

FOREIGN PATENT DOCUMENTS

| | | | |
|---|---|---|---|
| 1102604 | 6/1981 | Canada | 162/57 |

OTHER PUBLICATIONS

Gullichsen et al.; "Medium Consistency Technology", *TAPPI*, vol. 64, No. 9, Sep. 1981, p. 113.

*Primary Examiner*—Steve Alvo
*Attorney, Agent, or Firm*—Nixon & Vanderhye

[57] ABSTRACT

A method of preparing a pulp for digestion in a continuous process from a fiber-containing cellulose material is described. It comprises the following sequential steps:

(a) preimpregnating the fiber material by mixing it with cooking liquor so as to form a fiber suspension having a fiber concentration of about 5–15 percent by weight, (b) impregnating and fluidizing the fiber suspension under a pressure above atmospheric pressure by feeding the fiber suspension into a centrifugal fluidizing pump which exerts shearing forces on the fiber suspension so as to separate and at least partially disintegrate fiber bundles, (c) feeding the fiber suspension to a press by means of said centrifugal pump while continuing the pressure impregnation of the fiber material with cooking liquor from the fiber suspension, (d) thickening the fiber suspension by dewatering it in said press while subjecting the fiber suspension to a final impregnation under a pressure above atmospheric pressure so as to form a substantially completely impregnated pulp having a fiber concentration of about 20 to 40 (preferably 20 to 30) percent by weight, and (e) feeding the resultant pulp into a digester under the pressure created mainly or completely by the centrifugal pump.

17 Claims, 2 Drawing Sheets

METHOD OF PREPARING A PULP USING A FLUIDIZING CENTRIFUGAL PUMP DURING IMPRENATION

FIELD AND BACKGROUND OF THE INVENTION

The present invention relates to a method of preparing a pulp for digestion in a continuous process from a fiber-containing cellulose material.

U.S. Pat. No. 3 620 911 discloses a method of preparing a paper pulp from a fibrous nonwoody lignocellulose plant material having fibers and pith therein. After wet depithing the plant material and separating the pith from the fibers the resultant fiber slurry is partially dewatered and the fibers are then impregnated by adding an alkaline hydroxide solution to the fiber slurry, said impregnation being non-continuous and performed at atmospheric pressure. The mixture of impregnated fibers and alkaline hydroxide solution is then subjected to a digestion process.

Some types of plant material, such as bagasse, contain various types of fibre tissues which have different ability to absorb cooking liquor and hence different cooking requirements. The more reactive tissues require less chemicals for digestion but have the highest take-up of chemicals, i.e. they are the easiest for the cooking liquor to permeate. Conversely, the denser and harder tissues have the lowest degree of take-up and require more chemicals for digestion. The last-mentioned tissues, generally pertaining to the schlerenquima of the cane, provide the best fibers yielding the strongest pulp after digestion.

In commercial operation, bagasse fibers are cooked to the requirements of said denser tissues in order to reduce the amount of reject. Consequently, the more open and reactive tissues are digested for longer than is in fast necessary. More chemicals than theoretically needed are therefore used and the yield and final pulp quality are reduced. Such problems are associated with the method described in the above-mentioned U.S. Pat. No. 3,620,911 and also in U.S. Pat. No. 2,913,362 relating to a non-continuous method of producing cellulosic pulp.

SUMMARY OF THE INVENTION

The object of the present invention is to provide an improved method of preparing a pulp for digestion wherein the chemical liquor is distributed much more uniformly throughout the pulp in order to compensate for the inherent uneven chemical take-up, before feeding the pulp into the digester. Little or no addition of cooking liquor to the digester is needed since the pulp is already thoroughly impregnated throughout the various types of fibre tissues. The impregnated pulp is then digested much more evenly in a shorter time, and requiring less steam than prior art methods. Furthermore, a maximum yield and quality are obtained.

The present invention relates to a method of preparing a pulp for digestion in a continuous process from a fiber-containing cellulose material comprising the following sequential steps:

(a) preimpregnating said fiber material by mixing it with cooking liquor so as to form a fiber suspension having a fiber concentration of about 5–15 percent by weight, (b) impregnating and fluidizing said fiber suspension under a pressure above atmospheric pressure by feeding the fiber suspension into a centrifugal pump comprising fluidization means exerting shearing forces on the fiber suspension so as to separate and at least partially disintegrate fiber bundles from each other, (c) feeding said fiber suspension to a press by means of said centrifugal pump while continuing said pressure impregnation of the fiber material with cooking liquor from the fiber suspension, (d) thickening said fiber suspension by dewatering it in said press while subjecting the fiber suspension to a final impregnation under a pressure above atmospheric pressure so as to form a substantially completely impregnated pulp having a fiber concentration of about 20 to 40, preferably 20 to 30, percent by weight, and (e) feeding the resultant pulp into a digester by means of the pressure created mainly or completely by the centrifugal pump.

BRIEF DESCRIPTION OF THE DRAWINGS

The invention will be described further in the following with reference to the accompanying drawings.

DETAILED DESCRIPTION OF THE DRAWINGS

Figure 1:
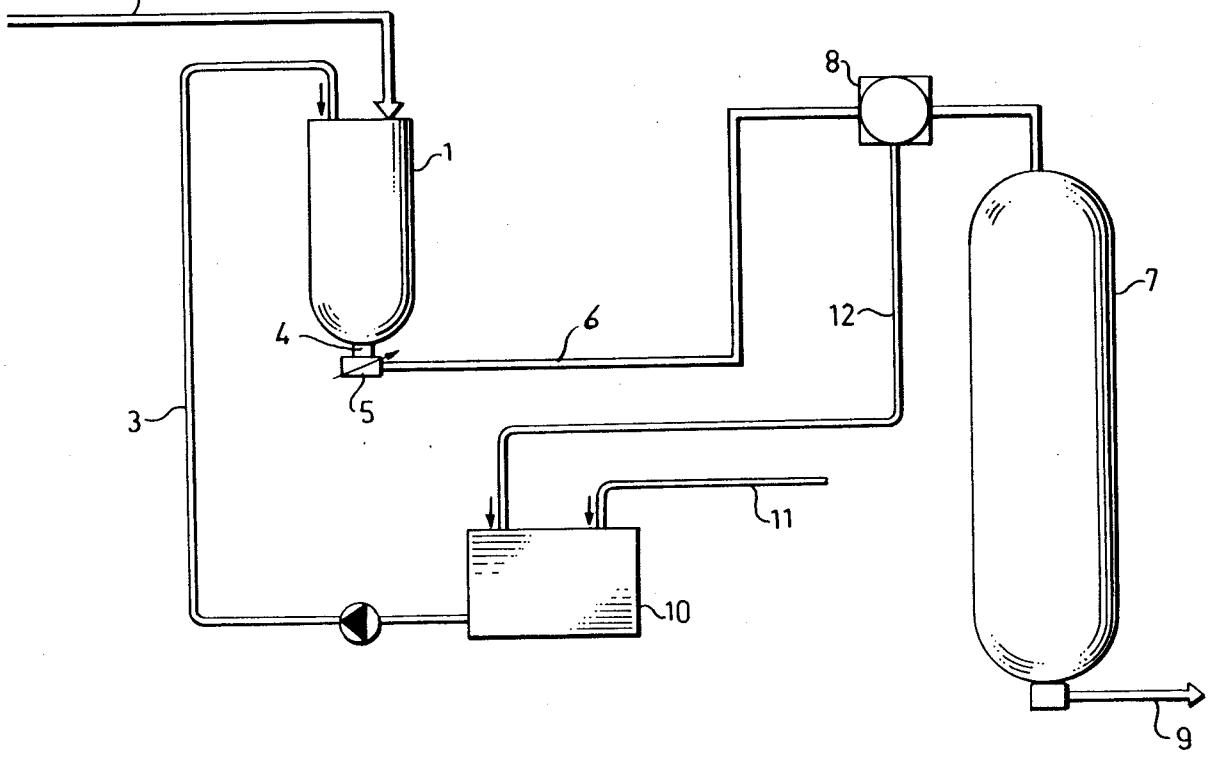
FIG. 1 shows schematically a plant for preparing a pulp from a fibrous nonwoody cellulose material according to the method of the present invention.

With reference to FIG. 1 a plant is schematically shown therein for impregnating and cooking fibrous nonwoody cellulose material, said plant comprising a vessel 1 having an inlet means 2 for supplying steamed fibrous nonwoody cellulose material. The inlet means 2 may consist of a nonpressure feeding device, such as a conveyor, or, particularly if a slight superatmospheric pressure is used or desired in vessel 1, by a conventional rotary pocket valve feeding system. Furthermore the vessel 1 has an inlet pipe 3 for supplying cooking liquor, and an outlet 4 for the mixture of said cellulose material and cooking liquor. The outlet 4 is connected to a centrifugal pump 5 which comprises a fluidization means, such as the Kamyr MC-pump. The centrifugal pump 5 is connected by a conduit 6 to a digester 7 via a press 8, such as a screw press, for instance. The press 8 is designed to resist digester pressure. The cooked pulp is transferred through an outlet pipe 9 to a blow tank (not shown). Cooking liquor is charged to the vessel 1 from a tank 10 through said pipe 3. In the press 8 excess liquid is pressed out and fed to the tank 10 through a pipe 12. Make-up chemicals, such as white liquor, black liquor or concentrated cooking chemicals, for instance, are added to the tank 10 through a pipe 11 under thoroughly controlled conditions.

In operation the steamed fiber material in disintegrated form is mixed with cooking liquor in the vessel 1 in order to commence a preimpregnation stage at atmospheric pressure.

When the preimpregnated fiber material enters the centrifugal pump 5 the fluidization means thereof subjects the fiber material to shearing forces so that the suspension is transferred into a fluidized condition. A suitable pump of this type is described in U.S. Pat. No. 4,435,122. By this fluidization the individual fiber bundles are separated from each other so that each fiber bundle will receive a necessary amount of cooking chemicals. In this way all types of tissues are exposed to receive cooking liquor, i.e. also the tissues which are more dense, compact and harder. Fluidization also results in a more homogenous mixture of fiber material and cooking liquor. The centrifugal pump 5 is operated to give a pressure which is about 50 to 100 percent of the pressure in the digester 7 measured at the inlet of the press. At the same time as the mixture of fiber material and cooking liquor is fluidized it will be subjected to an impregnation at the increased pressure provided by the centrifugal pump 5. This pressure impregnation continues when the mixture is fed by the centrifugal pump 5 through the conduit 6 to the press 8 in which the effect of the pressure impregnation is enhanced further.

The press 8 provides a final pressure impregnation of the mixture of fiber material and cooking liquor and ensures a further penetration of cooking liquor into the fibres and fiber bundles. This is particularly important when the fiber material contains denser and more compact fiber bundles which have to be impregnated with cooking liquor in a sufficient degree.

The press 8 serves several purposes. It removes excess cooking liquor from the fiber material before feeding the mixture into the digester. It provides a final pressure impregnation of all kinds of tissues, even those which are more difficult to penetrate under normal conditions. It increases the fiber concentration of the discharged mixture to a desired level. In other words, in addition to providing a final pressure impregnation the press acts as a thickening device by dewatering the mixture of fiber material and cooking liquor to a consistancy suitable for the cooking stage. Due to the small pressure difference between the outlet and inlet ends of the press it is possible to operate with alkaline cooking liquors which would normally give the pulp a slippery consistency which might cause problem particularly in screw presses operating at higher pressure differences. The cooking liquor retained in the fiber material is controlled and adjusted by previous additions and dewatering processes so that it contains a sufficient amount of cooking chemicals for the cooking process. As described above, the excess cooking liquor extracted from the press 8 is recirculated to the supply tank 10.

From the press 8 the pulp is fed into the digester 7 which can be of any suitable type, e.g. a continuous horizontal or vertical digester. As will be understood the pressure required to feed the pulp into the digester is mainly provided by the pump 5. The pressure difference over the press is relatively small, such as about 1 to 2 bars. The pressure maintained in the digester may be about 7 bars, for instance, whereby the pump 5 provides a feeding pressure of about 5 to 6 bars measured at the inlet press. Generally the centrifugal pump 5 maintains the whole part of the system up to the press 8 under a high pressure. If desired, a disintegrating means can be mounted in the discharge end of the press or in the pipe between the press and digester. However, the fiber plug formed will be much less compact than is usually the case in conventional digesting systems using screw feeders. The centrifugal pump 8 reduces the problem of backwardly directed blowing from the digester 7 to a minimum. However, as a safety measure a nonreturn valve may be disposed in the conduit between the centrifugal pump 5 and the press 8.

Figure 2:
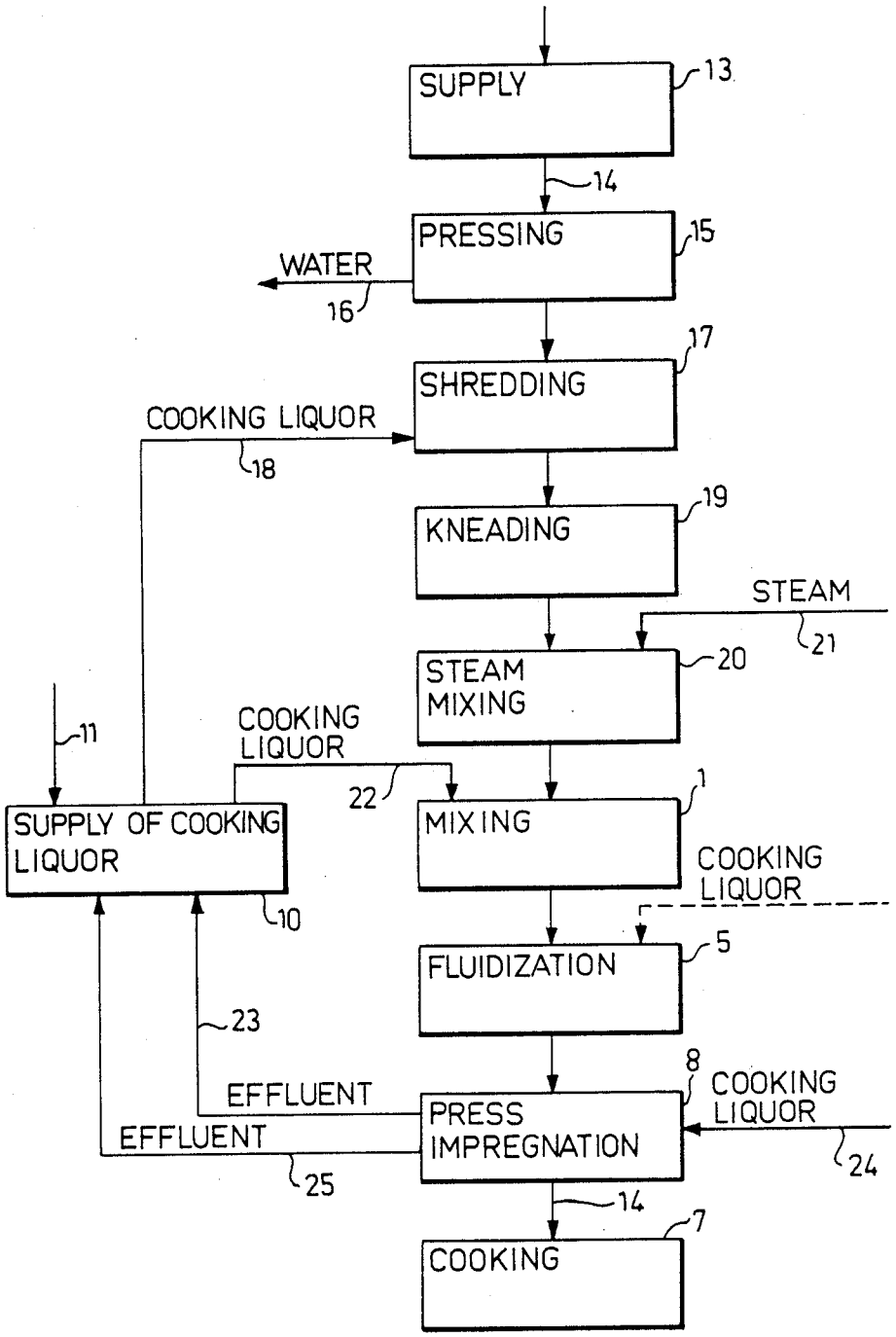
FIG. 2 shows a flow diagram of the method according to the invention utilizing the plant mainly as shown in FIG. 1 and further upstream equipment for preparing the pulp from the raw material.

FIG. 2 shows a flow diagram which, in addition to the plant mainly according to FIG. 1, includes equipment for pretreatment of the fibrous nonwoody cellulose plant material to a disintegrated form suitable to be fed into the vessel 1.

The raw material, such as depithed sugar cane bagasse having a fiber concentration of about 8 to 10%, is stored in a supply 13 from which the fiber material is fed in a fiber line 14 to the continuous digester 7 after passing a plurality of different treatment steps in the fiber line 14 in accordance with an embodiment of the present invention.

The first treatment step involves pressing the raw material in a suitable press 15 in order to remove as much liquid from the raw material as possible so that the load on the black liquor evaporators is reduced and cooking liquor can be supplied instead without being diluted in an undesired manner. A suitable fiber concentration after said pressing is about 30–35% when the raw material is bagasse. The press liquid is transferred to a water recovery system through a pipe 16 while the bagasse is fed to a shredding apparatus 17 which brakes up and opens fiber lumps formed in the previous pressing operations. At the outlet of the shredding apparatus 17 a predetermined amount of cooking liquor may be added through a pipe 18 in order to decrease the fiber concentration. The bagasse is then fed to a kneading apparatus 19, such as FROTAPULPER ®, in which it is subjected to a kneading action so that fiber bundles will be opened further and the take-up of chemicals improved. The kneading action also starts the preimpregnation, if cooking liquor has been added previously, and results in a more uniform chemical distribution. The kneading action is controlled and regulated very carefully by the power input in order not to damage the fibers. No steam is added in or before the kneading apparatus and therefore the chemical action is kept at a low level.

The bagasse thus disintegrated is fed into a steam mixer 20 to which steam is supplied through a pipe 21 in order to increase the temperature to a predetermined level, such as 70°–80° C. The steamed bagasse is then charged to the vessel 1 to which a further amount of cooking liquor is added via the pipe 22 so that a fiber concentration of about 5–15% is obtained, i.e. the resultant pulp or suspension will contain an excess of cooking liquor.

The suspension thus obtained by the described mechanical treatment of the steamed fiber material and the addition of cooking liquor is then fed into the centrifugal pump 5 which comprises a fluidization means subjecting the pulp to shearing forces such that the pulp is transferred into a fluidized condition as described above.

The centrifugal pump 5 feeds the pulp to an oblong press 8 having different treatment zones. In a first pressing zone the pulp is subjected to compression for removing the excess cooking liquor. This effluent is fed through a pipe 23 to the tank 10 containing the supply of cooking liquor. In a subsequent or intermediate zone of the screw press 8 fresh cooking liquor, thus forming an excess amount, is added and absorbed in said intermediate zone through a pipe 24.

Subsequently to this absorption zone there is a second pressing zone in which the pulp is subjected to a further compression for removing the excess cooking liquor which is circulated to the tank 10 via a pipe 25. The repeated press operations in the screw press provide final impregnation of the pulp and ensure further penetration of cooking liquor into the fibres and fiber bundles. The screw press 8 increases the fiber concentration of the discharged pulp to a desired level, such as about 25 to 35%, preferably about 30%.

The method described above with reference to FIG. 2 enables additions of cooking liquor to the pulp at least three points of the fiber line 14, the first one in the shredding apparatus 17, the second one in the vessel 1, and the third addition to the screw press 8. If desired, cooking liquor may also be added to the centrifugal pump 5. The preimpregnation of the pulp in the fiber line 14 before the screw press 8, the impregnation of the pulp in centrifugal pump 5 and the conduit 6, and the final press impregnation in the screw press 8 ensure that the pulp fed into the digester is fully impregnated and no further addition of cooking liquor is normally needed. The digestion can therefore be carried out at maximum possible consistency under thoroughly controlled conditions. Furthermore, higher fiber concentration results in the use of less steam for digestion and the digestion cycle can be reduced to a minimum so that yield, quality and costs are optimized.

The method according to the present invention is particularly applicable to fiber materials of non-homogeneous structure in the form of fibrous nonwoody lignocellulose plant material such as sugar cane bagasse, cotton stalks, corn stalks, flax, ramie, hemp, sisal, esparto, and other agricultural plant materials such as straws, stalks and stems usually delivered as residues.

All types of digestion procedures are applicable such as the kraft, soda and neutral sodium sulfite methods.

That which is claimed is:

1. A method of preparing a pulp for continuous digestion in a continuous process from a fiber-containing cellulose material by continuously, sequentially:

(a) immersing said fiber material in cooking liquor and mixing it with cooking liquor so as to form a fiber suspension having a fiber concentration of about 5–15 percent by weight, (b) impregnating and fluidizing said fiber suspension under a pressure above atmospheric pressure by feeding the fiber suspension into a fluidizing centrifugal pump which exerts shearing forces on the fiber suspension so as to separate, and at least partially disintegrate, fiber bundles, (c) feeding said fiber suspension to a press by means of said centrifugal pump while continuing said pressure impregnation of the fiber material with cooking liquor from the fiber suspension, (d) thickening said fiber suspension by dewatering it in said press while subjecting the fiber suspension to a final impregnation under a pressure above atmospheric pressure so as to form a substantially completely impregnated pulp having a fiber concentration of about 20 to 40 percent by weight, and (e) feeding the resultant pulp into a continuous digester under the pressure created at least mainly by the centrifugal pump.

2. A method as claimed in claim 1 wherein said immersing is carried out at atmospheric pressure or at a slight superatmospheric pressure.

3. A method as claimed in claim 1 wherein step (d) is practiced by dewatering the fiber suspension in at least two spaced pressing zones of said press, and adding cooking liquor is added in an intermediate zone of the press.

4. A method as claimed in claim 3 wherein an excess amount of cooking liquor is added to said intermediate zone of the press and that said excess amount of cooking liquor is removed in said second pressing zone of the press.

5. A method as claimed in claim 4 wherein said removed excess amount of cooking liquor is recycled to the fiber line.

6. A method as claimed in claim 1 wherein the centrifugal pump feeds the suspension to the press at a pressure, measured at the inlet of the press, of about 50 to 100% of the pressure prevailing in the digester.

7. A method as claimed in claim 1 comprising the further steps of prior to or contemporaneously with step (a), preparing the pulp from an aqueous fiber-containing material having a fiber concentration below about 20% subjecting said fiber material before said immersing to a dewatering operation to provide a fiber concentration of about 20 to 40%, and subjecting said fiber material to a disintegrating operation during which cooking liquor is added so as to form a suspension.

8. A method as claimed in claim 7 wherein said disintegrating operation comprises shredding and kneading in order to open the fiber lumps, separate individual fiber lumps from each other distribute the cooking liquor, and initiate the immersing.

9. A method as claimed in claim 2 comprising the further steps of prior to or contemporaneously with step (a), heating the fiber material by presteaming to a temperature of about 70°–120 ° C.

10. A method as claimed in claim 1 wherein said final pressure impregnation is carried out by means of a screw press.

11. A method as claimed in claim 1 wherein said fiber-containing cellulose material is as depithed sugar cane bagasse.

12. A method as recited in claim 1 wherein step (d) is practiced so as to form a substantially completely impregnated pulp having a fiber concentration of about 20–30% by weight.

13. A method as recited in claim 2 comprising the further step of prior to or contemporaneously with step (a), heating the fiber material by presteaming to a temperature of about 80°–100° C.

14. A method as recited in claim 12 comprising the further step of prior to or contemporaneously with step (a), heating the fiber material by presteaming to a temperature of about 80°–100° C.

15. A method as recited in claim 3 wherein step (d) is practiced so as to form a substantially completely impregnated pulp having a fiber concentration of about 20–30% by weight.

16. A method as recited in claim 7 wherein said dewatering operation before immersing is practiced to provide a fiber concentration of about 30–40%.

17. A method as recited in claim 8 wherein said dewatering operation before immersing is practiced to provide a fiber concentration of about 30–40%.

* * * * *